US006266820B1

(12) United States Patent
Gupta et al.

(10) Patent No.: US 6,266,820 B1
(45) **Date of Patent: *Jul. 31, 2001**

(54) DISPOSABLE BIB HAVING STRETCHABLE SHOULDER EXTENSIONS

(75) Inventors: Amit Gupta; Patricia L. Lampson; Karen Leeker, all of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/059,884

(22) Filed: Apr. 14, 1998

(51) Int. Cl.[7] ..... A41B 13/10
(52) U.S. Cl. ..... 2/49.1
(58) Field of Search ..... 2/48, 49.1, 49.2, 2/49.4, 49.5, 50, 51, 52, 46

(56) References Cited

U.S. PATENT DOCUMENTS

| | | | |
|---|---|---|---|
| 3,286,279 | 11/1966 | Brown | 2/19 |
| 3,329,969 | 7/1967 | Farber et al. | 2/49 |
| 3,608,092 | 9/1971 | Taranto | 2/49 R |
| 3,654,629 | 4/1972 | Crisman et al. | 2/49 |
| 3,916,447 | 11/1975 | Thompson | 2/46 |
| 3,979,776 | 9/1976 | Gruenwald | 2/49 R |
| 4,107,364 | 8/1978 | Sisson | 428/196 |
| 4,186,443 | 2/1980 | Britzman | 2/49 R |
| 4,191,609 | 3/1980 | Trokhan | 162/113 |
| 4,416,025 | 11/1983 | Moret et al. | 2/49 R |
| 4,441,212 | 4/1984 | Ahr et al. | 2/49 R |
| 4,445,231 | 5/1984 | Noel | 2/49 R |
| 4,495,658 | 1/1985 | Moret et al. | 2/49 R |
| 4,523,333 | 6/1985 | Spangler | 2/49 R |
| 4,523,334 | 6/1985 | Lavash | 2/49 R |
| 4,529,480 | 7/1985 | Trokhan | 162/109 |
| 4,637,859 | 1/1987 | Trokhan | 162/109 |
| 4,646,365 | 3/1987 | Suprise et al. | 2/49 R |
| 4,797,952 | 1/1989 | Petrini | 2/49 R |
| 4,834,741 | 5/1989 | Sabee | 604/385.2 |
| 4,846,822 | 7/1989 | Foxman | 603/370 |
| 4,884,299 * | 12/1989 | Rose | 206/390 |
| 5,074,013 | 12/1991 | Arnold et al. | 24/713 |
| 5,143,679 | 9/1992 | Weber et al. | 264/288.8 |
| 5,156,793 | 10/1992 | Buell et al. | 264/288.8 |
| 5,167,897 | 12/1992 | Weber et al. | 264/288.8 |
| 5,223,096 | 6/1993 | Phan et al. | 162/158 |
| 5,240,562 | 8/1993 | Phan et al. | 162/158 |
| 5,518,801 | 5/1996 | Chappell et al. | 428/152 |
| 5,620,430 | 4/1997 | Bamber | 604/385.2 |
| 5,650,214 | 7/1997 | Anderson et al. | 428/152 |
| 5,822,792 | 10/1998 | Reinhart | 2/49.1 |

* cited by examiner

*Primary Examiner*—Amy B. Vanatta
(74) *Attorney, Agent, or Firm*—Jay A. Krebs; David M. Weirich; Ken K. Patel

(57) ABSTRACT

A bib having an area on each shoulder extension which is permanently elongated to provide extensibility and elasticity which minimizes distortion of the bib body as the shoulder extensions are fastened around a wearer's neck. The area on each shoulder extension can include a strainable network. The network can be formed in a laminate of a paper layer and a plastic film layer. The strainable network can have at least two visually distinct regions.

17 Claims, 9 Drawing Sheets

DISPOSABLE BIB HAVING STRETCHABLE SHOULDER EXTENSIONS

FIELD OF THE INVENTION

The present invention is related to disposable bibs, and more particularly, to a disposable bib having a pair of shoulder extensions, each of which includes a permanently elongated area providing stretchable shoulder extensions.

BACKGROUND OF THE INVENTION

Disposable bibs are well known in the art. Such bibs can be provided for use on babies during feeding. Disposable bibs can have a laminate construction comprising multiple layers. For instance, disposable bibs can include an absorbent paper topsheet for receiving spilled food material and a plastic film backsheet for preventing penetration of spilled liquids through the bib and onto the baby's clothing. Other multiple layer bib constructions are also known.

In order to be effective, a bib must fit closely against a wearer's body adequately covering the frontal area, including the shoulders, as well as portions of the wearer's sides. Laminate structures can be relatively stiff. A relatively stiff bib has a tendency of gapping away from a wearer's body as shoulder extensions are draped across shoulders and fastened around the neck. The gapping exposes surfaces of the wearer's clothing to food and liquids that may be spilled by the wearer while in use.

A bib that is relatively flexible, particularly one having stretchable shoulder extensions, can eliminate the gapping by enabling the shoulder extensions to stretch around a wearer's neck and conform to the contour of the wearer's shoulders. One way of producing stretchable shoulder extensions is by including an elastic material in the laminate making up the shoulder extension. Although such a combination is effective in providing flexible shoulder extensions, the added cost associated with including the elastic material makes the application impractical for a disposable bib product.

SUMMARY OF THE INVENTION

The present invention provides a disposable bib comprising a bib body, a pair of shoulder extensions extending from the bib body to provide a generally planar neck opening. Each shoulder extension includes a permanently elongated area that is stretched beyond its elastic limit. The permanent elongation provides the shoulder extensions with extensibility and elasticity which enables them to wrap around a wearer's neck and conform to the contour of the shoulders without distorting the bib body.

In one embodiment, the permanently elongated area comprises a strainable network including at least one first region and at least two second regions. The first region undergoes a substantially molecular level deformation and the second region initially undergoes a substantially geometric deformation as the shoulder extensions are wrapped around the wearer's neck.

The first region and the second regions are visually distinct from one another. The first region is substantially planar while the second regions include a plurality of raised rib-like elements. The orientation of the two distinct regions may take on a number of different arrangements to provide shoulder extensions having elastic like behavior. A preferred arrangement includes a planar first region extending parallel to a longitudinal centerline of the bib and raised rib-like elements of the second regions positioned orthogonal to the longitudinal centerline.

A preferred embodiment includes a strainable network on each shoulder extension extending between a side edge of the shoulder extension and the neck opening wherein the extensibility of the strainable network increases as the side edge is approached in a traverse direction from the neck opening.

Another embodiment includes a strainable network on each shoulder extension designed to form a pockets when placed over a wearer's shoulder. The pocket increases the shoulder extension coverage and minimizes movement of the shoulder extension relative to the shoulder as the wearer moves about.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

In addition, FIG. 8 illustrates a strainable network wherein the surface pathlength within each second region varies.

DETAILED DESCRIPTION OF THE INVENTION

Figure 1:
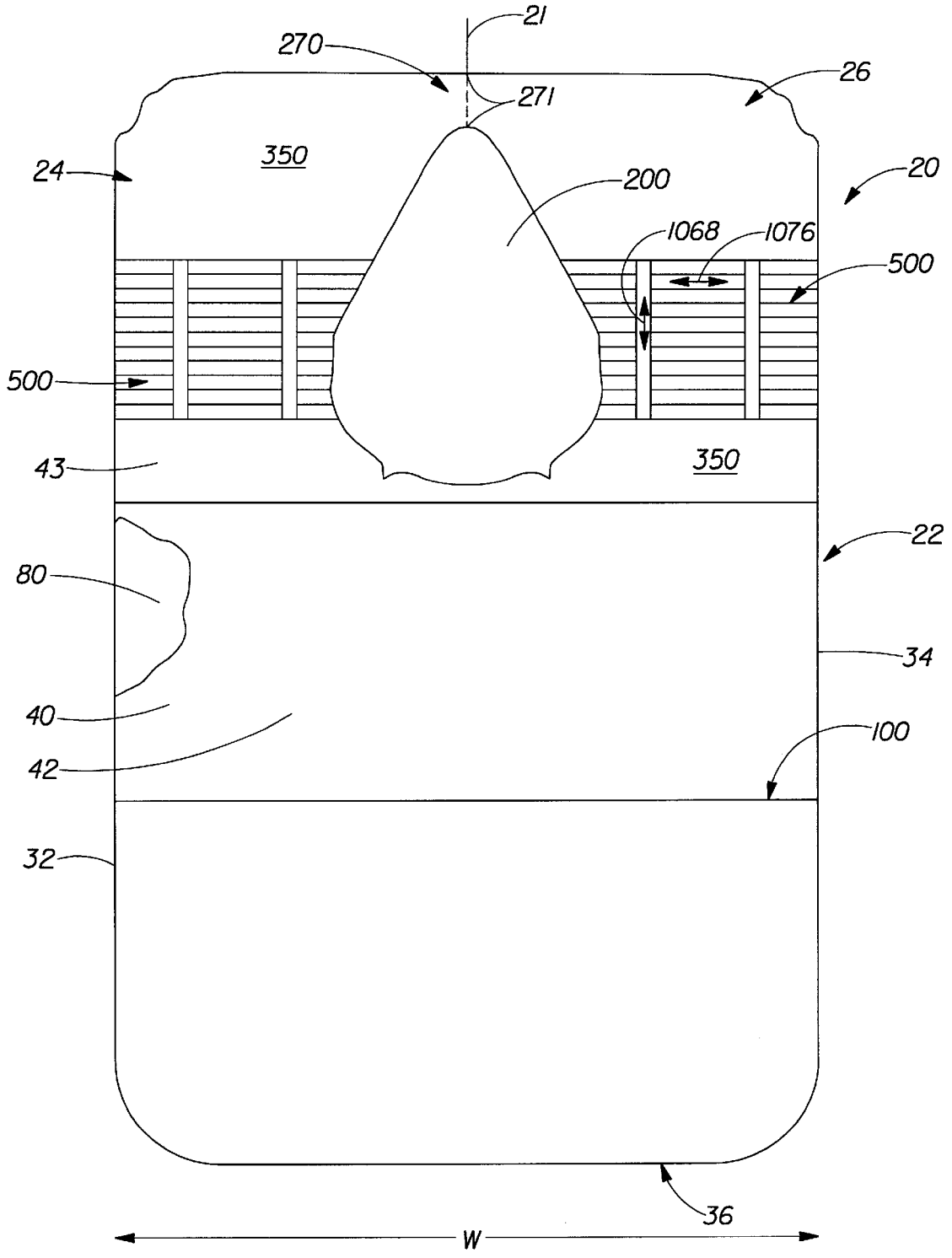
FIG. 1 is a front plan view of the disposable bib of the present invention wherein the bib is supported in a flat, generally planar orientation.
Figure 2:
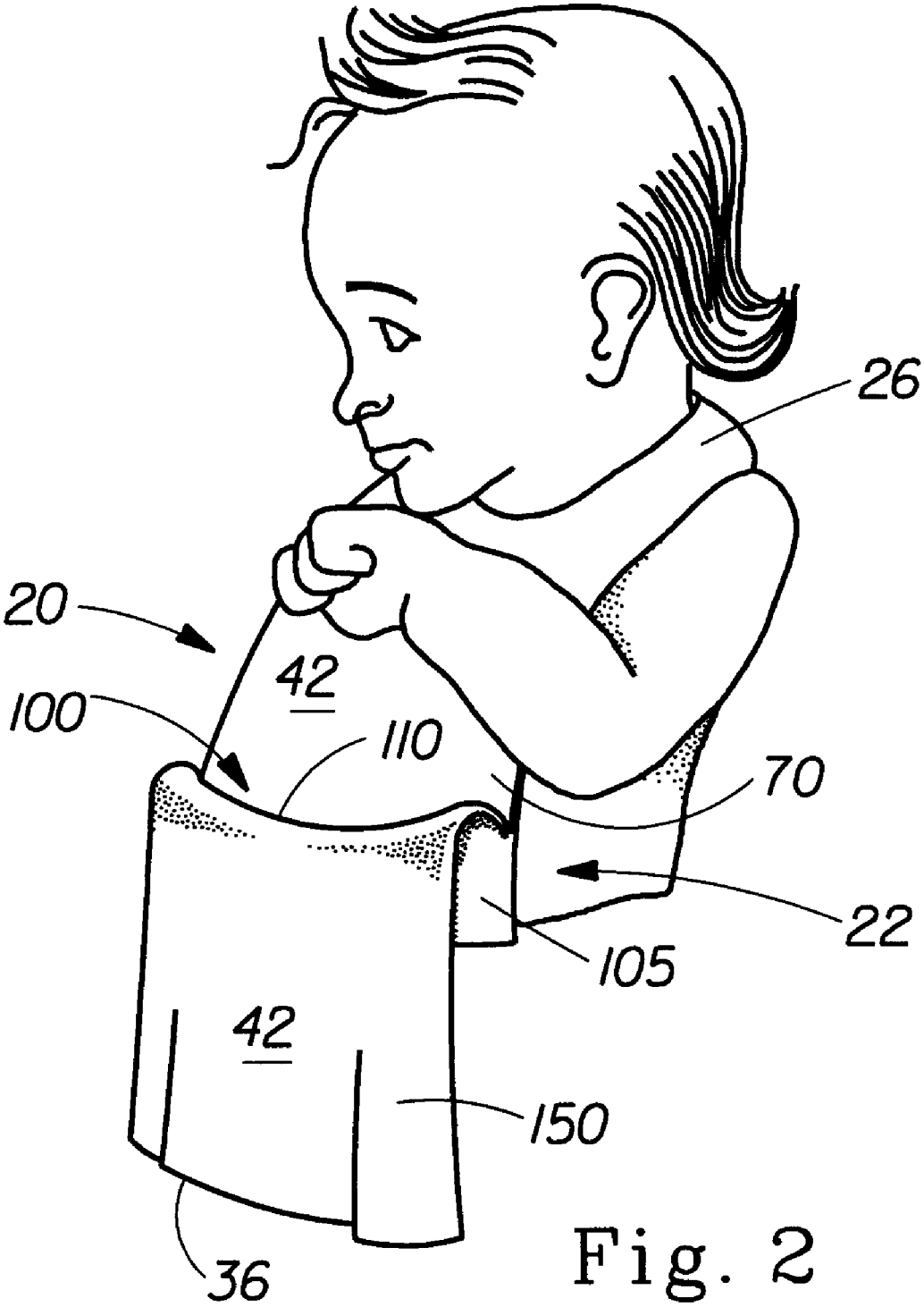
FIG. 2 is an in use perspective view of a disposable bib according to the present invention.

FIGS. 1–2 illustrate a disposable bib 20 according to one embodiment of the present invention. The bib 20 is useful for children or adults to protect clothing from spilled food material.

The present invention provides a disposable bib 20, wherein at least one portion of the bib 20 is permanently elongated to provide improved extensibility of that portion of the bib during subsequently applied loading, such as subsequently applied forces and/or elongations.

In particular, the present invention provides a disposable bib having a pair of shoulder extensions 24 and 26, each of which includes a permanently elongated area 500 that is stretched beyond its elastic limit. The permanent elongation provides the shoulder extensions with extensibility and elasticity enabling them to be wrapped around a wearer's neck and conform to the contour of the shoulders without distorting the bib body.

By "permanently elongated" it is meant that a portion of the bib is stretched beyond its elastic limit, and that upon removal of the mechanism causing the stretching, the portion of the bib retains a deformed configuration having a length which is greater than the corresponding initial length of that portion of the bib prior to stretching.

By "improved extensibility" it is meant that the portion which has been previously permanently elongated has the characteristic that it extends (or lengthens) in the plane of the bib, under a subsequently applied load in the plane of the bib, to a greater degree than the portion would extend if the same level of loading were applied to the portion of the bib prior to the portion of the bib being permanently elongated. The plane of the bib is parallel to the plane of FIG. 1.

In addition to providing extensibility, the permanently elongated portions result in Z-direction bulking of the bib (the Z-direction is perpendicular to the plane of FIG. 1), such that surfaces of the bib have texture in the form of relatively raised regions and relatively recessed regions, such as in the form of corrugations, rib-like elements, peaks and valleys, and the like.

Further, such texture and Z-direction bulking is provided without the use of elastic elements or elastic gathering methods. Such surface texture not only provides an elastic fit, but can also be useful in creating a perception of providing a comfortable fit.

Referring to FIGS. 1–2, the bib 20 comprises a bib body 22 having longitudinally extending sides 32 and 34, a longitudinal length, a longitudinal centerline 21, a laterally extending bottom edge 36, and a lateral width W. The term "longitudinal" refers to an axis or direction measured along the length of the bib body 22, which direction or axis is generally parallel to a line extending from the wearer's head to the wearer's waist, as the bib is worn. The terms "lateral" and "transverse" refer to a direction or axis which is perpendicular to the longitudinal centerline 21, and which is generally parallel to a line extending across the wearer's chest as the bib is worn. The term inboard refers to a direction extending toward the longitudinal centerline 21. The term outboard refers to a direction extending away from the longitudinal centerline 21.

The shoulder extensions 24, 26 extend from the bib body 22 from their proximal ends to their distal ends to provide a generally planar neck opening 200 when the bib is supported on a flat, horizontal surface.

The bib can comprise a laminate of at least two layers. Referring to FIG. 1, the bib body 22 comprises a laminate construction. The laminate includes a first paper layer 40 and a second plastic film layer 80. In FIG. 1, a portion of the paper layer 40 is shown cut away to reveal the plastic film layer 80. The outer surface 42 of the paper layer 40 faces the viewer in FIG. 1. The body facing surface of the second plastic film layer 80 is not shown.

The bib 20 can also include a pocket 100 extending substantially the full lateral width of the bib 20 for catching and receiving food particles. Referring to FIG. 2, the bib body 22 can comprise a body panel 70, a pocket panel 105, and an apron panel 150. The body panel 70 can be separated from the pocket panel 105 by a laterally extending fold in the bib body, and the pocket panel 105 can be separated from the apron panel 150 by another parallel laterally extending fold in the bib body 22. U.S. Pat. No. 4,445,231 "Bib Having Gravitationally Openable Pocket" issued May 1, 1984 to Noel is incorporated herein by reference for the purpose of showing a bib construction for forming a bib having a pocket and an apron panel.

Referring to the components of the bib 20 in more detail, the bib 20 according to one embodiment of the present invention comprises a composite construction having multiple laminae. The bib body 22 comprises a laminate of a first layer, such as an absorbent outer topsheet layer 40, and a second layer, such as a body facing backsheet layer 80 which is liquid impermeable relative to the topsheet 40. The topsheet 40 has an outer surface 42 for receiving spilled food material. The backsheet 80 has a body facing surface (not shown). The layer 40 and the layer 80 can be joined together, such as with an adhesive, to form a laminate. In one embodiment, the shoulder extensions 24, 26, the bib body panel 70, the pocket panel 105, and the apron panel 150 are formed from a single, continuous sheet of the laminate of the topsheet 40 and the backsheet 80.

The topsheet 40 can comprise a paper web having a basis weight of from about 10 to about 50 pounds per three thousand square feet. The following U.S. Patents are incorporated by reference for the purpose of disclosing how to make tissue paper suitable for use in making a topsheet 40: U.S. Pat Nos. 4,191,609; 4,529,480; 4,637,859; 5,223,096; and 5,240,562. A suitable topsheet 40 can be formed from a single ply or multiple ply paper towel. In one embodiment, the topsheet 40 comprises a two ply Bounty Paper Towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.3 mil and about 4.0 mil (about 0.0003 inch to about 0.0040 inch). In one embodiment the backsheet can comprise a FS-II embossed Polyethylene film having a thickness of about 2.0 mil and manufactured under the designation CPC-2 by Tredegar Film Products of Richmond, Va.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. Suitable adhesives include HL-1258 and HL 1262 adhesives manufactured by H. B. Fuller Co. of St. Paul, Minn.

In an alternate embodiment, a top portion 43 of the bib 20, including shoulder extensions 24, 26, may include top surface 350 comprising a nonwoven web of fibers directly bonded to the back sheet 80. A suitable nonwoven web is manufactured by the Fiberweb Corp. of Simpsonville, S.C. under the designation Celestra Unicorn.

Prior to the time the bib 20 is to be used, the shoulder extensions 24 and 26 can be joined together, such as at their distal ends, along a selective line of weakening 270. When the bib is to be used, the shoulder extensions are separable along the selective line of weakening 270, such that the shoulder extensions can be separated without tearing or otherwise damaging other portions of the bib 20, and releasably joined together in an overlapping fashion by the fastening assembly.

In one embodiment, the selective line of weakening 270 is aligned with the longitudinal centerline 21, and comprises a plurality of spaced apart perforations 271. The perforations 271 can extend partially or fully through the thickness of the bib 20. The perforations can be formed with a perforating knife, and can extend through each of the backsheet 80, topsheet 40, and nonwoven web.

Figure 3:
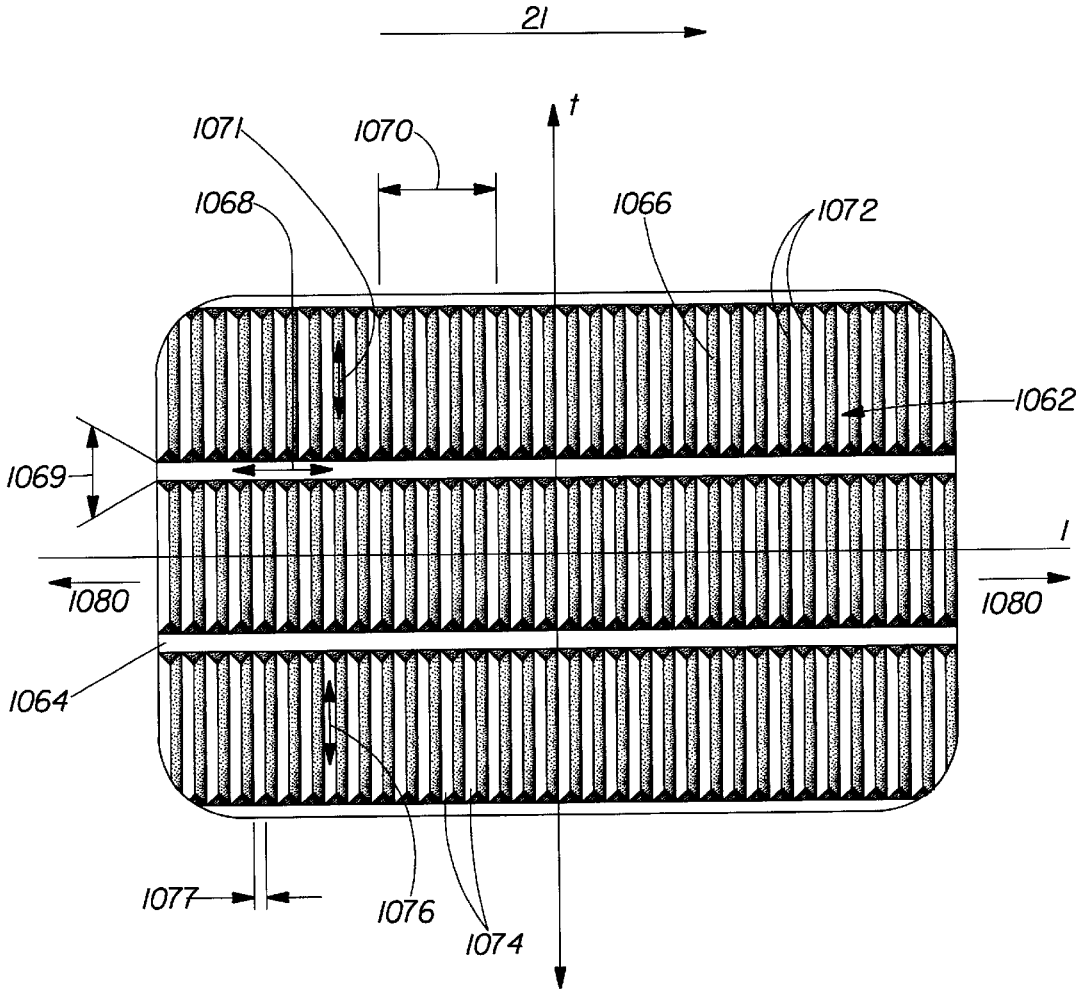
FIG. 3 is enlarged view of the strainable network portrayed in FIG. 1.

In the embodiment shown in FIG. 1, the area 500 of each shoulder extension is permanently elongated to provide a strainable network. An enlarged view of the strainable network is shown in FIG. 3. Such a strainable network is disclosed in U.S. Pat. No. 5,518,801 issued May 21, 1996 to Chappell et al., which patent is incorporated by reference herein. The strainable network provides elastic like behavior of the laminate along at least one axis, as disclosed in above referenced U.S. Pat. No. 5,518,801. The strainable network can be formed by permanently elongating portions of the bib using the apparatus shown in FIGS. 9–10, as described more fully below.

The term "strainable network" refers to an interconnected and interrelated group of regions which are able to be extended to some useful degree in a predetermined direction for providing a component with an elastic-like behavior.

The strainable network includes one or more first regions and one or more second regions. The first regions can undergo a substantially molecular level deformation, or a combination of molecular level deformation and geometric deformation in response to an subsequently applied elongation, such as an elongation applied to each shoulder extension once the strainable network is formed. The second regions initially undergo a substantially geometric deformation in response to a subsequently applied elongation, such as an elongation applied to each shoulder extension once the strainable network is formed.

The term "molecular level deformation" refers to deformation which occurs on a molecular level and is not discernible to the normal naked eye, such that even though one may be able to discern the effect of the molecular level deformation (e.g. elongation of a component), one is not able to discern the deformation which allows or causes the elongation. This is in contrast to "geometric deformation". The term "geometric deformation" refers to deformations which are discernible to the normal naked eye. "Geometric deformation" includes, but is not limited to, bending, unfolding, and rotating.

Referring to FIG. 3, the strainable network 1062 includes a plurality of first regions 1064 and a plurality of second regions 1066. The first regions 1064 have a first axis 1068 and a second axis 1069, wherein the first axis 1068 is longer than the second axis 1069. The first axis 1068 is substantially parallel to a longitudinal axis 1 of the network, and the second axis 1069 is substantially parallel to a transverse axis t of the network. The second regions 1066 have a first axis 1070 and a second axis 1071. The first axis 1070 is substantially parallel to the axis 1 of the network, and the second axis 1071 is substantially parallel to the axis t of the network.

In the embodiment shown in FIG. 3, the first regions 1064 are substantially planar. The second regions 1066 include a plurality of rib-like elements 1074. The rib-like elements 1074 have a first major axis 1076 which is substantially parallel to the axis t of the network, and a second minor axis 1077 which is substantially parallel to the axis 1 of the network. The rib-like elements 1074 extend outward from surrounding portions of the strainable network (toward the viewer in FIG. 3) to form ridges 1072. Valleys corresponding to the ridges 1072 form depressions in the laminated surface of the bib.

Referring to FIG. 3, when an elongation (indicated by arrows 1080) is applied to the strainable network generally parallel to axis 1, the rib-like elements 1074 are able to unbend or geometrically deform in a direction substantially perpendicular to their first axis 1076, thereby allowing elastic like extension of the strainable network generally parallel to the axis 1.

The first region 1064 and the second region 1066 each have a projected pathlength and a surface pathlength. The available elastic like extension or stretch of the strainable network is determined by the surface pathlength of the second region 1066 relative to the surface pathlength of the first region 1064 for a given projected pathlength.

Projected pathlength refers to the length of a shadow of a region measured parallel to the longitudinal axis 1 that would be thrown by parallel light. The projected pathlength of the first region is equal to the projected pathlength of an adjacent second region.

Surface pathlength is the length of the outermost region measured topographically in a direction parallel to the longitudinal axis 1 of the strainable network. Since the second region is typically comprised of rib-like elements where as the first region is typically planar, the surface pathlength of the second region exceeds the surface pathlength of the first region for each corresponding projected surface pathlength.

The surface pathlength of the second region is determined at least in part by the rib-like element spacing, rib-like element frequency, and the depth of formation of the rib-like elements measured in the Z-direction of the bib. In general, the greater the surface-pathlength of the second region, the greater the available stretch of the web material.

The available stretch within the second region may be varied along the longitudinal axis 1 of the strainable network by dividing a second region into zones and providing each zone with rib-like elements having different surface pathlengths. Similarly, the available stretch may be varied along the transverse axis t of the strainable network by providing adjacent second regions with rib-like elements having different surface pathlengths.

In FIG. 1, the strainable network 500 is disposed on each shoulder extension 24 and 26 between the neck opening 200 and each corresponding longitudinal side edge 32 and 34 on the laminate of the layers 350 and 80. As shown enlarged in FIG. 3, the orientation is such that the major axis 1076 of each rib-like element 1074 is generally orthogonal to the longitudinal centerline 21 and the first axis 1068 of the planar first region is parallel to the longitudinal centerline 21. Accordingly, the strainable network provides elastic like behavior of the laminate of the layers 350 and 80 making the shoulder extension extendible in at least the longitudinal direction.

The elastic behavior of the strainable network as applied to the laminated structure shown in FIG. 3 results in an elasticity of at least about 10 percent elongation, preferably about 10 to about 50 percent elongation, and more preferably between about 15 percent and about 35 percent elongation.

Since shoulder extension 24 and 26 are made to wrap around and the wearer's neck and drape over shoulders, a preferred embodiment includes shoulder extensions having a strainable network providing extensibility having components in both the longitudinal and transverse directions. This is accomplished by providing a strainable network having extensibility which increases laterally outboard of the neck opening. In one embodiment illustrated in FIG. 4, the strainable networks 500 are triangular in shape wherein the bases of the triangles are disposed contiguous with, and preferably, parallel to the longitudinally extending side edges 32 and 34. The apexes of the triangularly shaped portions converge at points (not shown) located inboard of the side edges. Although the apex of each triangularly shaped network may be disposed at any location inboard of the corresponding side edge, the preferred point of convergence is inside the neck opening 200.

The result is a strainable network comprising a permanently elongated area which continuously increases outboard of the neck opening 200. Accordingly, the extensibility of each of the shoulder extensions increases laterally outboard of the neck opening providing extensibility in a direction having both transverse and longitudinal components.

Figure 4:
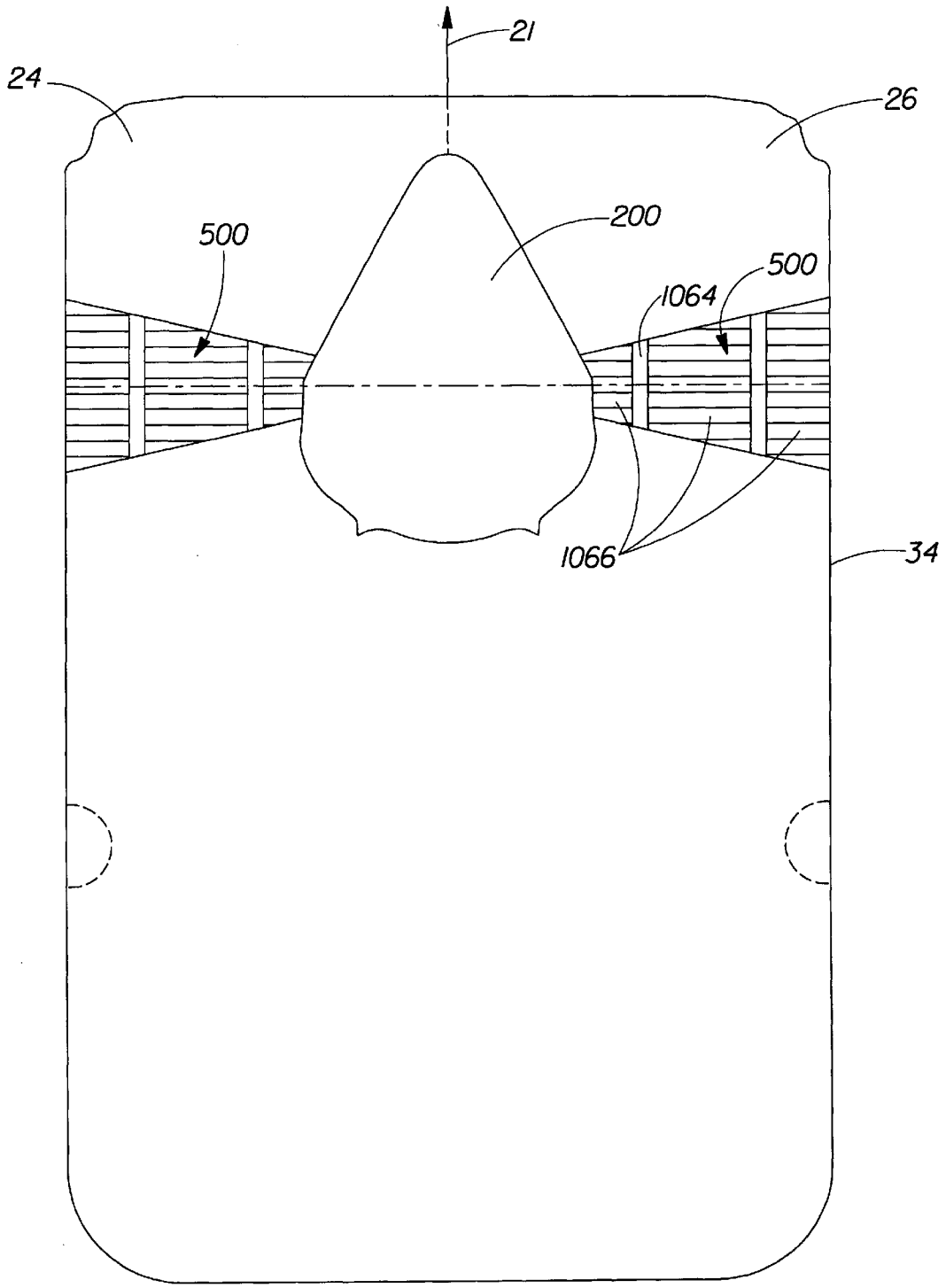
FIG. 4 is an in an alternate embodiment of the strainable network portrayed in FIG. 1 showing a strainable network that is triangular in shape.
Figure 5:
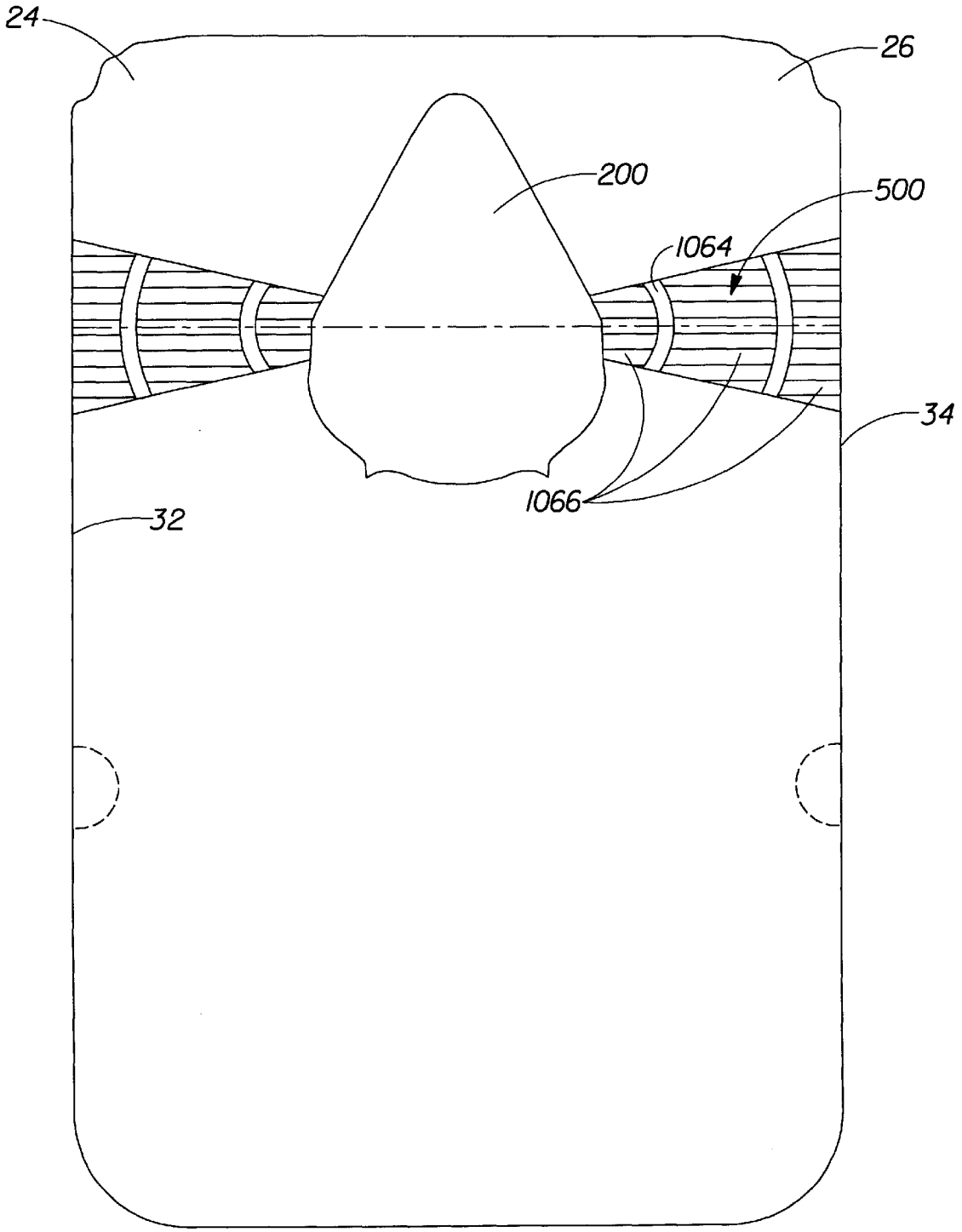
FIG. 5 is an alternate embodiment of the triangularly shaped strainable network portrayed in FIG. 4 showing curvilinear planar first regions which are concave toward the centerline.

An alternate embodiment shown in FIG. 5, provides a similar triangularly shaped strainable network 500 as shown in FIG. 4 having curvilinear, planar first regions 1064 oriented concave toward the longitudinal centerline 21. The curvilinear planar first regions enhance the transverse component of extensibility and in addition, create an appearance which conforms to the contour of the wearer's shoulders.

Figure 6:
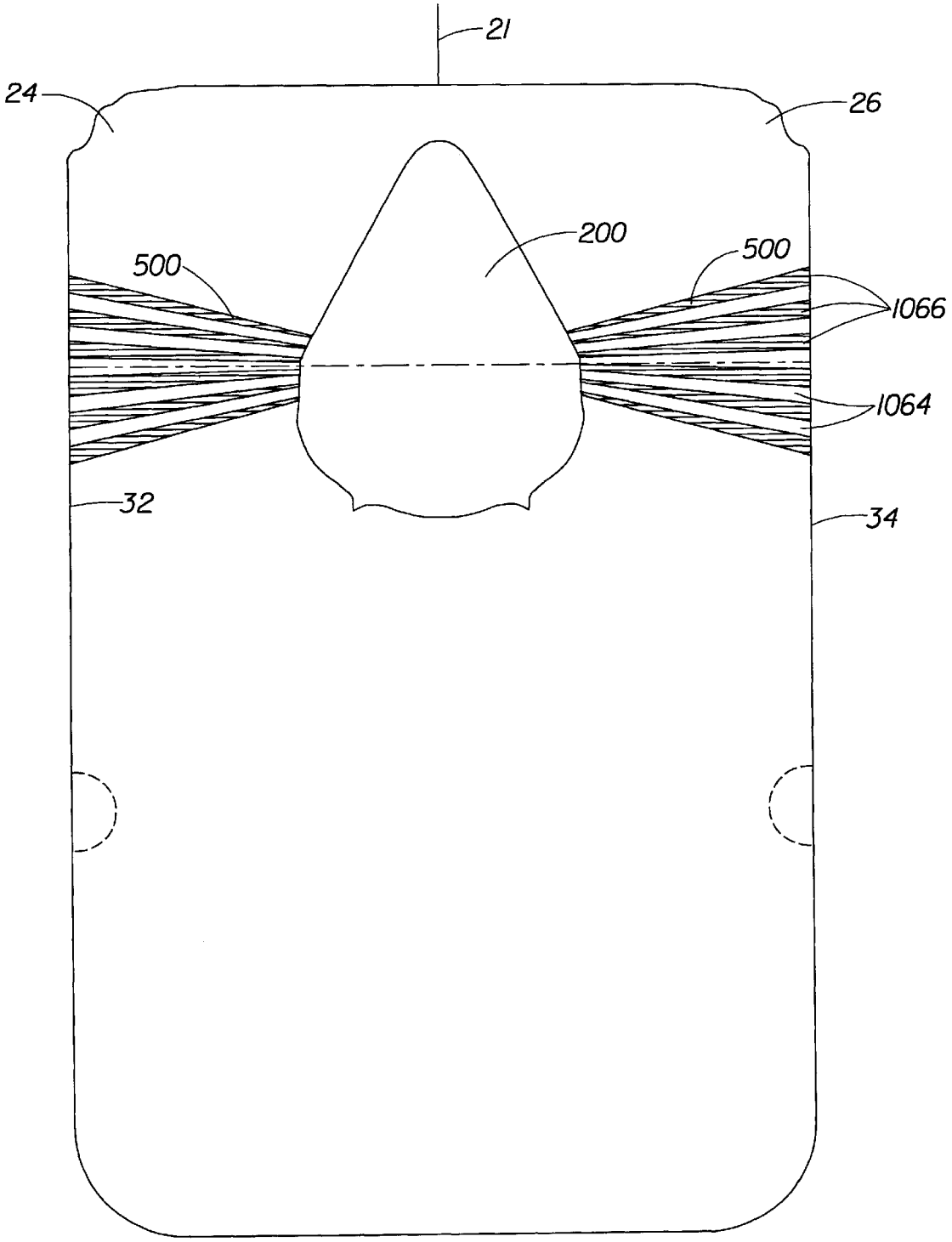
FIG. 6 is an alternate embodiment of the triangularly shaped strainable network portrayed in FIG. 4, showing the planar first regions extending laterally between the longitudinally extending side edge and the neck opening and converging toward the neck opening.

An alternate embodiment shown in FIG. 6, provides a similar triangularly shaped strainable network as shown in FIG. 4 having linear, planar first regions 1064 extending laterally between the neck opening and the longitudinal side edge, inclined to the traverse axis, converging toward the apex. Similar to the curvilinear planar first regions shown in FIG. 5, the inclined planar first regions enhance the transverse component of extensibility and create an appearance which conforms to the contour of the wearer's shoulders.

Figure 7:
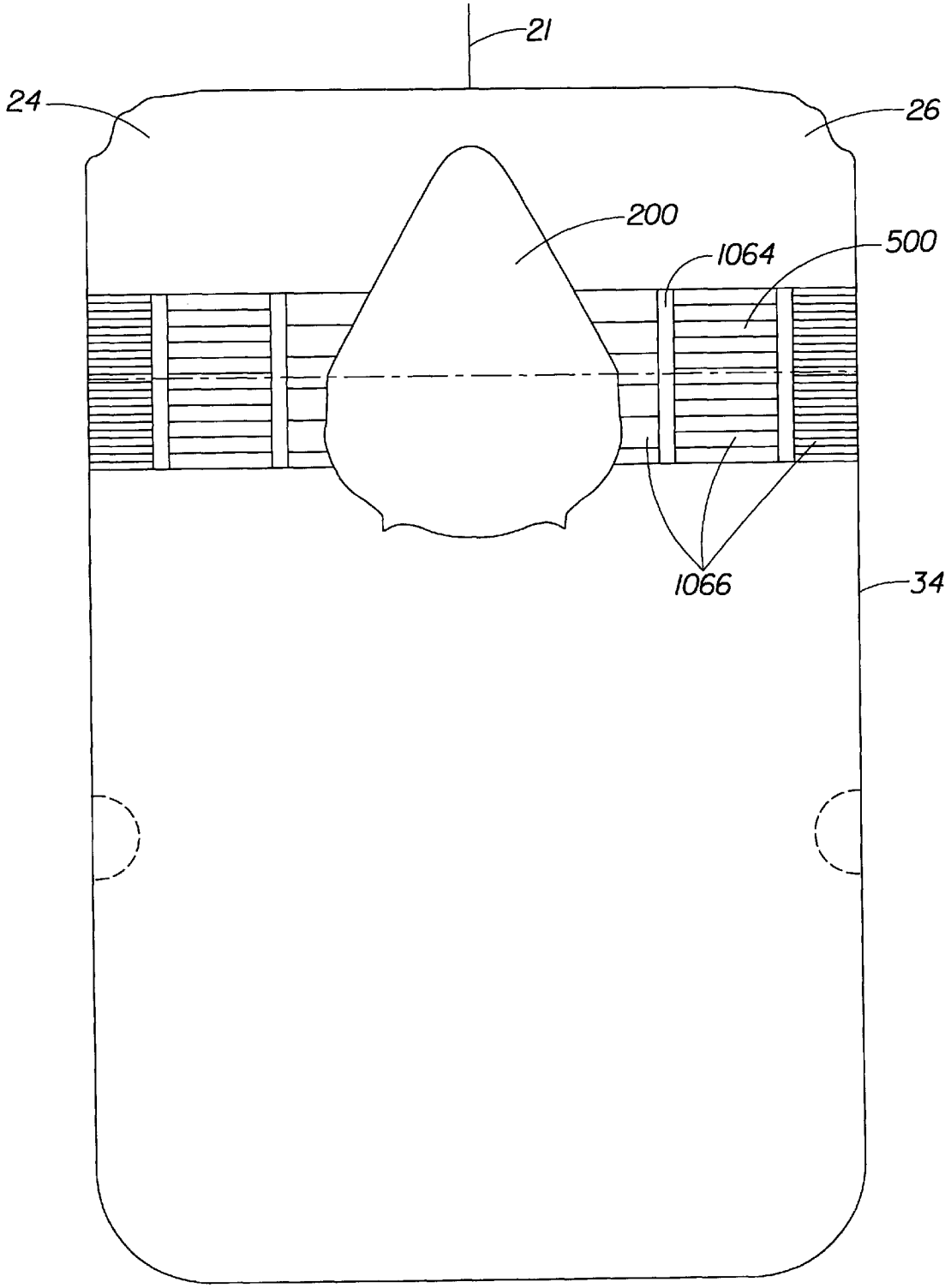
FIG. 7 is an alternate embodiment of the strainable network portrayed in FIG. 1, illustrating that the available extensibility can be increased laterally by increasing the surface pathlengths of adjacent second regions within the strainable network.

An alternate embodiment shown in FIG. 7, provides shoulder extensions including strainable networks 500 that are rectilinear in shape. For this configuration, each adjacent second region 1066 disposed outboard the neck opening has a greater surface pathlength than its predecessor. The result is a strainable network having extensibility which increases in the lateral direction outboard of the neck opening 200 providing extensibility in a direction having both lateral and longitudinal components.

In order to ensure that the bib adequately protects the wearer's shoulders from spilled food or beverage, the strainable networks may be arranged on the shoulder extensions to create pockets which form in the Z-direction enclosing the tops of the wearer's shoulders. The pockets not only provide increased coverage of the shoulders but also minimize the movement of the shoulder extensions relative to the shoulders as the wearer moves about.

Figure 8:
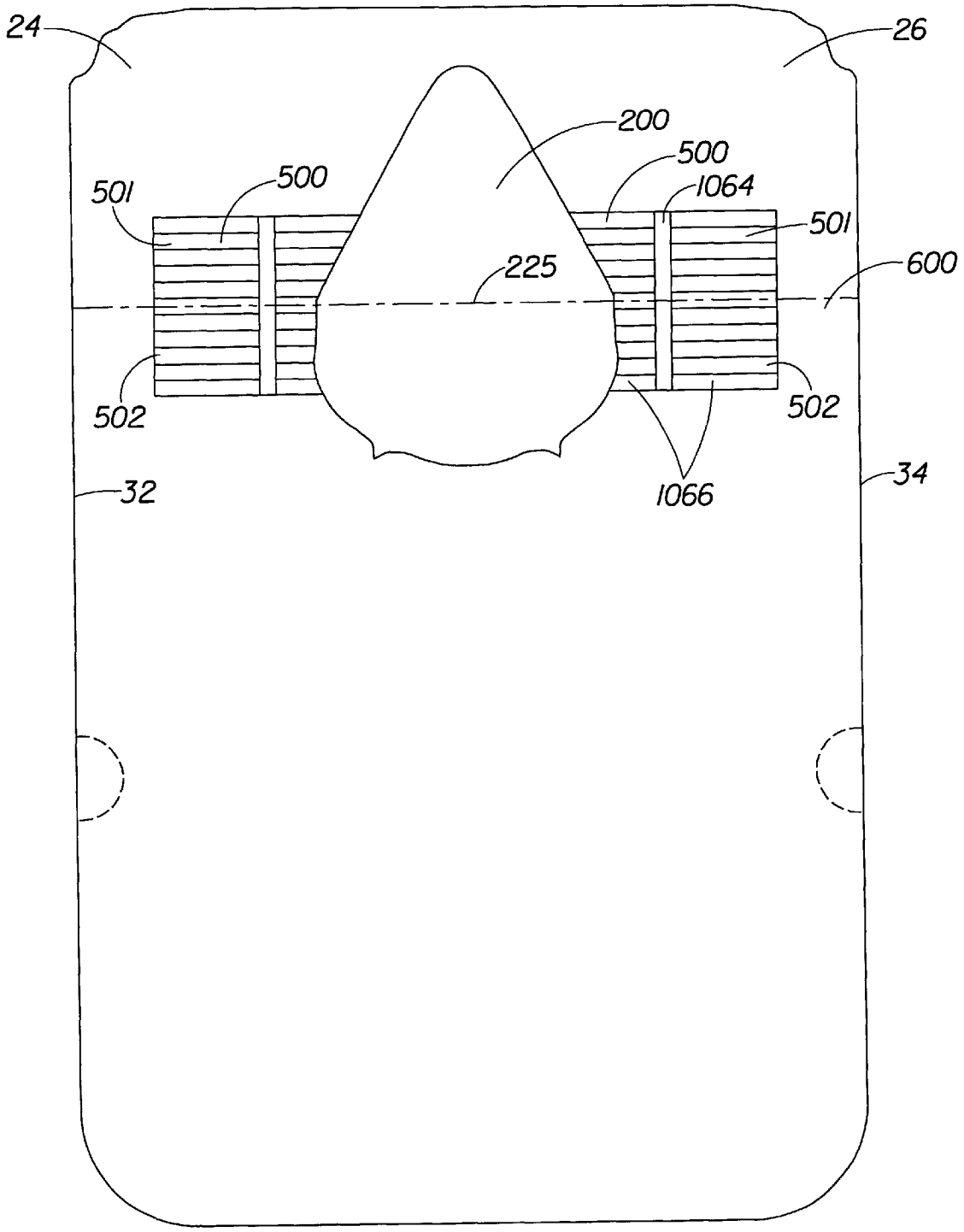
FIG. 8 is an alternate embodiment of the strainable network portrayed in FIG. 1, illustrating a non-permanently elongated portion interposed between the strainable network and the longitudinally extending side edge.

In an alternate embodiment shown in FIG. 8, the strainable network 500 on each shoulder extension 24, 26 is made to form a pocket that encloses the top of the shoulder. The strainable network on each shoulder extension is disposed laterally inboard of the longitudinally extending side edge providing a portion 600 which is not permanently elongated interposed between the strainable network 500 and the longitudinally extending side edge. Since the non-elongated portion 600 is non extendible, disposing the non-elongated portion 600 adjacent to the strainable network enables the strainable network to bulge and form a pocket as each shoulder extension is placed over the wearer's shoulder.

In order to provide a strainable network having the extensibility necessary to form a pocket that is large enough to cover the top of a shoulder, the extensibility of the strainable network may be designed according to the contour of a typical shoulder. One option includes a strainable network that provides maximum extensibility at the peak or top of the shoulder.

In an alternate embodiment shown in FIG. 8. the strainable network in each shoulder extension includes a lateral centerline 225 which is approximately contiguous with the peak of a typical wearer's shoulder. The lateral centerline separates the network into an upper area 501 and a lower area 502. By varying the surface pathlengths within each of the second regions such that the surface pathlengths increase as the centerline 225 is longitudinally approached from either the upper area or the lower area, a strainable network is created having maximum extensibility at the lateral centerline 225.

One skilled in the art can appreciate that the strainable network shown in FIG. 8, may be coupled with the other embodiments previously described. Such combinations can provide a strainable network having pocket forming capability along with extensibility in a direction having both longitudinal and transverse components.

Figure 9:
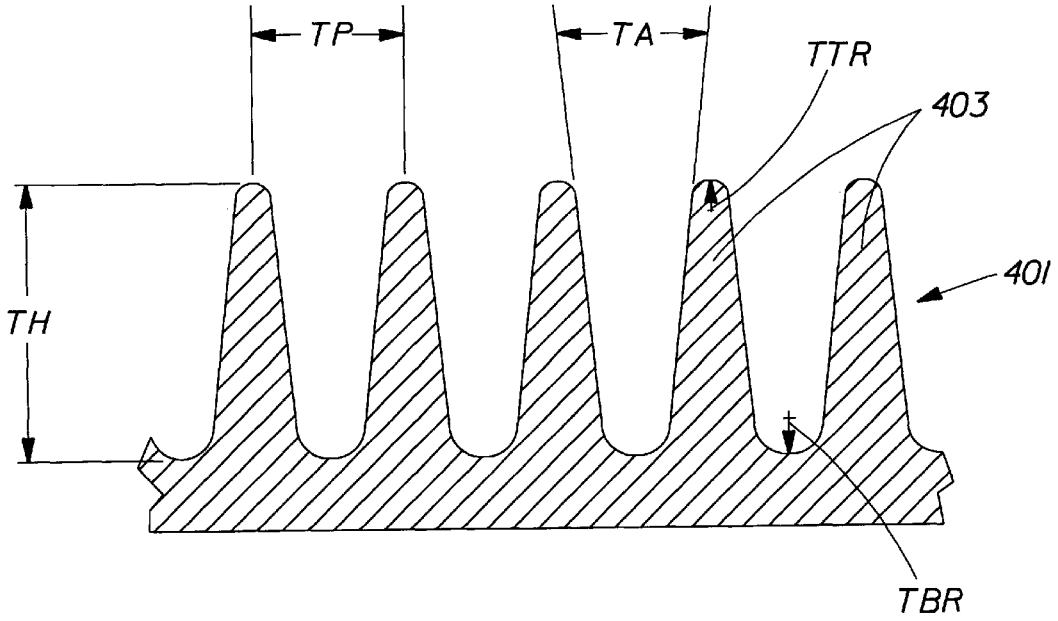
FIG. 9 is a cross-sectional illustration of a portion of a toothed apparatus used to form the strainable networks shown in FIGS. 1.
Figure 10:
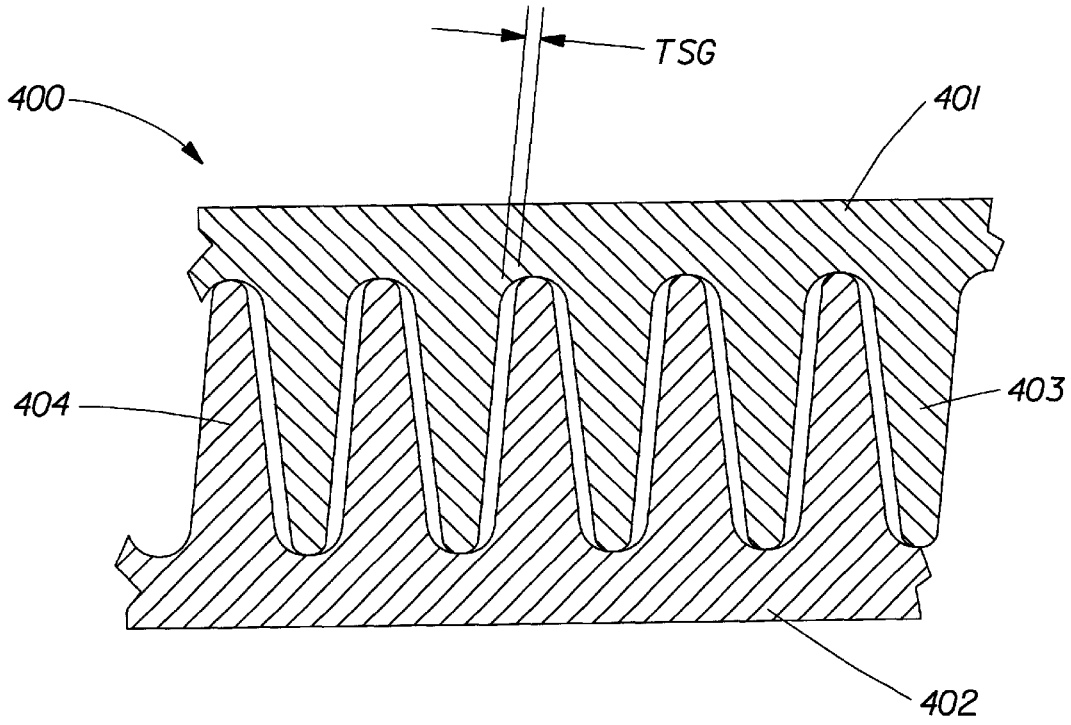
FIG. 10 is a cross-sectional illustration of an apparatus showing engagement of the teeth used to form the strainable network shown in FIG. 1.

FIG. 9 is a cross-sectional illustration of a portion of a toothed apparatus 401 which can be used to permanently elongate portions of the bib and thereby form the strainable network. FIG. 10 is a cross-sectional illustration of an apparatus showing engagement of the teeth 403 and 404 used to form the strainable network. Referring to FIG. 10, the apparatus 400 includes intermeshing plates 401 and 402. Plates 401 and 402 include a plurality of intermeshing teeth 403, 404, respectively. The strainable network is formed by placing the bib laminate between the plates 401 and 402, and bringing the plates 401, 402 together under loading to form the strainable network. Preferably, the paper topsheet 40 is positioned against the plate 402 and the backsheet 80 is positioned against the plate 401.

Plate 402 includes toothed regions and grooved regions (not shown). Within the toothed regions there are a plurality of teeth 404. Plate 401 includes teeth 403 which mesh with teeth 404 of plate 402. When a substrate, such as a laminate of topsheet 40 and backsheet 80, is formed between plates 401, 402, the portions of the substrate which are positioned between grooved regions of plate 402 and teeth 403 on plate 401 remain undeformed. These regions correspond to the first regions 1064. The portions of the substrate positioned between toothed regions of plate 402 and teeth 403 of plate 401 are permanently elongated, creating rib-like elements 1072 in the second regions 1066.

The plate 401 is shown in cross-section in FIG. 9. The teeth 403 (and the teeth 404 on plate 402) can have the following characteristics to form a strainable network in the laminate comprising the paper topsheet 40 and the plastic film backsheet 80: The tooth height TH can be about 0.0800 inch, the tooth pitch TP can be about 0.0400 inch, the tooth angle TA can be about 11.31 degrees, the tooth tip radius TTR can be about 0.0040 inch, and the tooth base radius TBR can be about 0.0093 inch.

FIG. 10 shows intermeshing of the plates 401 and 402 without a substrate positioned between the plates. The plates 401 and 402 can intermesh to have a tooth side gap TSG of about 0.0048 inch, as shown in FIG. 10.

While the embodiments above are described in terms of a bib 20 having shoulder extensions 24, 26 with an integral strainable network 500 the invention is not so limited. For example, the strainable network 500 may be separately formed off-line. These strainable networks are then joined to the shoulder extension 24, 26 using adhesive, ultrasonic welding, thermal sealing etc. as is well known in the art.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A disposable bib having a longitudinal centerline, a lateral width and longitudinally extending side edges, said bib comprising a bib body; and a pair of shoulder extensions extending from the bib body to provide a generally planar neck opening, wherein each said shoulder extension includes a permanently elongated portion interposed between said neck opening and a longitudinally extending side edge, said permanently elongated portion providing extensibility and elasticity to said shoulder extension.

2. The disposable bib of claim 1, wherein the permanently elongated portion is disposed contiguous with the longitudinally extending side edge.

3. The disposable bib of claim 1, wherein the permanently elongated portion is disposed apart from the longitudinally extending side edge such that a non-permanently elongated portion is interposed between the longitudinally extending side edge and the permanently elongated portion.

4. A disposable bib of claim 1, wherein the permanently elongated portion of each said shoulder extension includes a strainable network comprising at least one first region and at least two second regions, the first region undergoing a substantially molecular level deformation and the second regions initially undergoing a substantially geometric deformation.

5. The disposable bib of claim 4, wherein each first region is substantially planar and each second region comprises a plurality of raised rib-like elements.

6. The disposable bib of claim 5, wherein each planar first region extends parallel to the longitudinal centerline and wherein the raised rib-like elements run between the planar first regions, orthogonal to the longitudinal centerline.

7. The disposable bib of claim 5, wherein each planar first region is concave toward said neck opening, and wherein the raised rib-like elements run between the planar first regions, orthogonal to the longitudinal centerline.

8. The disposable bib of claim 4, wherein the extensibility of the strainable network increases as the longitudinally extending side edge is laterally approached from said neck opening.

9. The disposable bib of claim 8, wherein the strainable network is triangular in shape including a base extending parallel to the longitudinally extending side edge and two sides converging towards an apex, the apex being laterally spaced inboard from the side edge.

10. The disposable bib of claim 9, wherein the strainable network includes a plurality of planar first region extending between the base and said neck opening, converging toward the apex.

11. The disposable bib of claim 8, wherein each first region and each second region has a surface-pathlength and wherein the surface-pathlength of each second region is greater than the surface-pathlength of each first region.

12. The disposable bib of claim 11, wherein the surface-pathlength of each second region increases as the longitudinally extending side edge is laterally approached from said neck opening.

13. The disposable bib of claim 11 or claim 12, wherein the permanently elongated portion includes a lateral centerline dividing the permanently elongated portion into an upper area and a lower area, and wherein the surface pathlength within each second region increases as the lateral centerline is longitudinally approached from the upper area or the lower area.

14. The disposable bib of claim 1, wherein each shoulder extension includes a portion which is not permanently elongated.

15. A disposable bib having a longitudinal centerline, a lateral width and longitudinally extending side edges, said bib comprising a bib body; and a pair of shoulder extensions extending from the bib body to provide a generally planar neck opening, wherein each said shoulder extension includes an extensible region, wherein the extensibility of the extensible region increases as the longitudinally extending side edge is laterally approached from said neck opening.

16. The disposable bib of claim 15, wherein the extensible region is triangular in shape including a base extending parallel to the longitudinally extending side edge and two sides converging towards an apex, the apex being laterally spaced inboard from the longitudinally extending side edge.

17. The disposable bib of claim 16, wherein the apex is disposed internal to said neck opening.

* * * * *